US008049108B2

(12) United States Patent
Hartings et al.

(10) Patent No.: US 8,049,108 B2
(45) Date of Patent: Nov. 1, 2011

(54) HIGH VOLTAGE BUSHING AND HIGH VOLTAGE DEVICE COMPRISING SUCH BUSHING

(75) Inventors: Ralf Hartings, Ludvika (SE); Björn Jacobson, Grängesberg (SE); Olof Heyman, Ludvika (SE); Dan G. Gustavsson, Ludvika (SE); Rutger Johansson, Ludvika (SE)

(73) Assignee: ABB Technology Ltd., Zürich (CH)

( * ) Notice: Subject to any disclaimer, the term of this patent is extended or adjusted under 35 U.S.C. 154(b) by 656 days.

(21) Appl. No.: 12/159,620

(22) PCT Filed: Dec. 22, 2006

(86) PCT No.: PCT/SE2006/001489
§ 371 (c)(1),
(2), (4) Date: Jun. 28, 2008

(87) PCT Pub. No.: WO2007/078237
PCT Pub. Date: Jul. 12, 2007

(65) Prior Publication Data

US 2009/0000806 A1 Jan. 1, 2009

Related U.S. Application Data

(60) Provisional application No. 60/754,655, filed on Dec. 30, 2005.

(51) Int. Cl.
*H01B 17/26* (2006.01)

(52) U.S. Cl. ..... 174/142; 174/11 BH; 174/14 BH; 174/152 R; 174/137 R; 174/650; 156/69

(58) Field of Classification Search ..... 174/142, 174/167, 168, 11 BH, 12 BH, 14 BH, 152 R, 174/137 R, 650; 156/69
See application file for complete search history.

(56) References Cited

U.S. PATENT DOCUMENTS 3,962,667 A * 6/1976 Link ..... 337/202
4,159,401 A * 6/1979 Kamata ..... 174/31 R
4,584,429 A * 4/1986 Raketti et al. ..... 174/18

FOREIGN PATENT DOCUMENTS

EP 0109836 A2 5/1984

OTHER PUBLICATIONS

PCT/ISA/210—International Search Report—Mar. 27, 2007.
PCT/ISA/237—Written Opinion of the International Searching Authority—Mar. 27, 2007.

* cited by examiner

*Primary Examiner* — Dhirubhai R Patel
(74) *Attorney, Agent, or Firm* — Venable LLP; Eric J. Franklin

(57) ABSTRACT

A high voltage bushing for a high voltage device containing insulating liquid includes a voltage grading shield, improving performance and facilitating manufacturing.

15 Claims, 1 Drawing Sheet

HIGH VOLTAGE BUSHING AND HIGH VOLTAGE DEVICE COMPRISING SUCH BUSHING

CROSS-REFERENCE TO RELATED APPLICATIONS

This application claims priority to U.S. provisional patent application 60/754,655 filed 30 Dec. 2005 is the national phase under 35 U.S.C. §371 of PCT/SE2006/001489 filed 22 Dec. 2005.

FIELD OF INVENTION

The present invention relates generally to high voltage bushings and more particularly to a high voltage bushing partially submerged in an insulating liquid, such as oil. The invention also relates to a high voltage device comprising such bushing.

BACKGROUND

It is known that electrical equipment and devices, such as high voltage transformers, are usually equipped with bushings, which are suitable to carry current at high potential through a grounded barrier, e.g. a transformer tank or a wall.

Conventional high voltage transformer bushings are constituted by an insulator made of ceramic or composite material, which is provided with sheds and is generally hollow, and on the inside is the voltage grading performed with a condenser body comprising paper-oil or resin impregnated epoxy through which the electrical conductor passes, allowing to connect the inside of the device on which the bushing is fitted to the outside. Thus, the condenser core provides a smooth electric potential distribution between the high voltage and the grounded parts.

Common to transformer bushings with a condenser body is that the part of the bushing that is submerged in the transformer tank contains oil.

SUMMARY OF THE INVENTION

An object of the present invention is to provide a high voltage bushing which has good dielectric and thermal properties, which contains few parts and is easily adapted to different applications.

The invention is based on the realization that a bushing with a grounded shielding tube instead of a condenser core can be used in applications wherein part of the bushing is submerged in oil. This is the case in for example transformer bushings, which are submerged in transformer oil in a transformer tank.

According to a first aspect of the invention a high voltage bushing for a high voltage device containing insulating liquid is provided comprising a hollow insulator housing comprising a first side insulator arranged to be provided outside of the high voltage device and a second side insulator arranged to be submerged in the insulating liquid of the high voltage device, and a high voltage conductor provided in the hollow insulator housing; and being characterized by a voltage grading shield provided between the high voltage conductor and the insulator housing.

According to a second aspect of the invention a high voltage device comprising at least one such bushing is also provided.

With the inventive bushing, several advantages are obtained. By using a shielding tube, the bushing can be made completely dry, i.e., it contains no oil. Also, it has been shown that the electric field pattern in the bushing is almost identical for both AC and DC applications, making the bushing suitable for both AC and DC.

In a preferred embodiment, an insulating gas, such as SF6 or $N_2$ or mixtures thereof, is used as insulating medium inside the part of the bushing that is connected to the high voltage device. This provides good thermal properties due to the insulating gas and the open design allowing the gas to circulate inside the bushing.

BRIEF DESCRIPTION OF DRAWINGS

The invention is now described, by way of example, with reference to the accompanying drawing, in which the sole

DETAILED DESCRIPTION OF PREFERRED EMBODIMENTS

Figure 1:
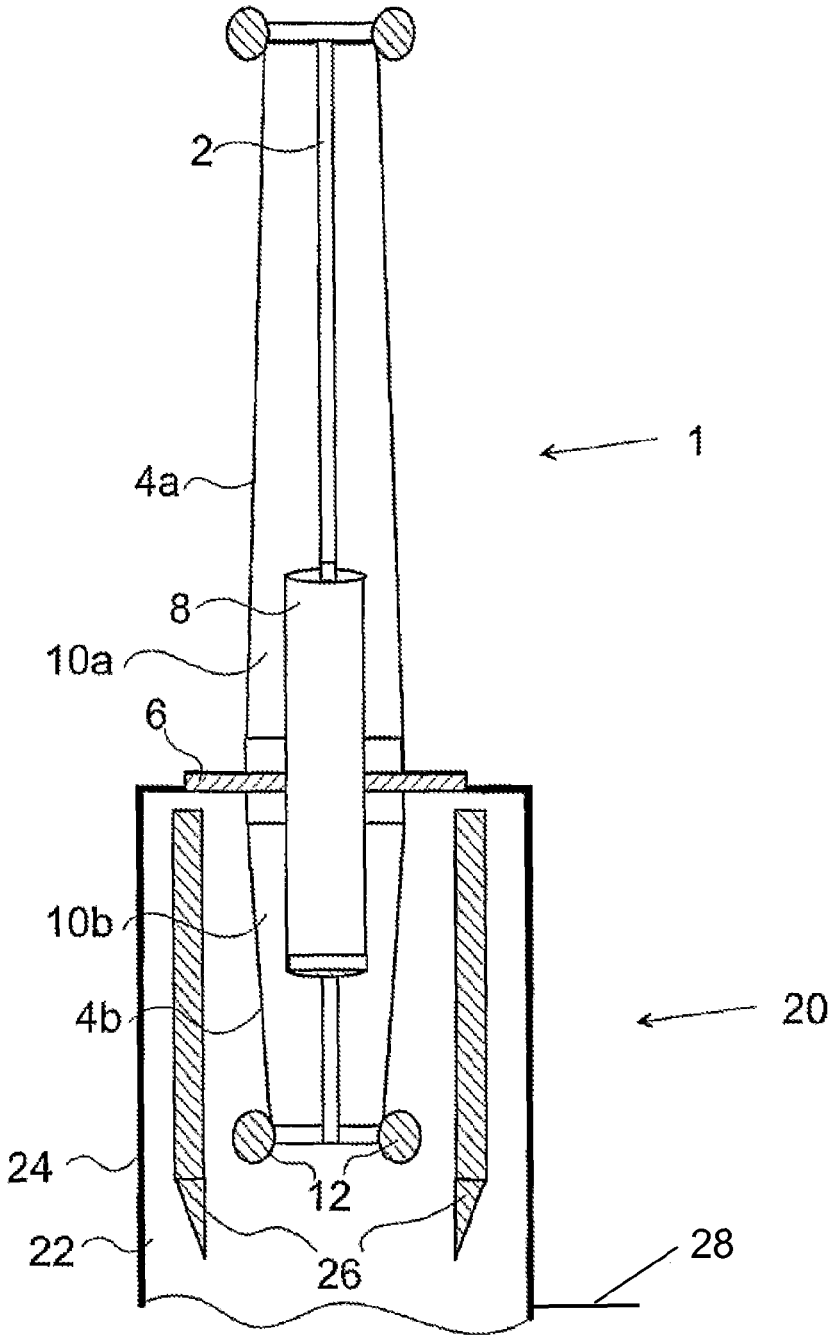
FIG. 1 is a sectional view of a high voltage bushing mounted to a high voltage device.

In the following a detailed description of a preferred embodiment of the present invention will be given. In this description, the term "high voltage" will be used for voltages of 50 kV and higher. Today, the upper limit in commercial high voltage devices is 800 kV but even higher voltages, such as 1000 kV or more, are built or envisaged in the near future.

Also, in this description the term "voltage grading shield" should be read to exclude condenser cores conventionally found in bushings arranged to be submerged in insulating liquid.

Reference is now being made to the FIGURE.

The bushing, generally designated 1, comprises a high voltage conductor 2 that extends through the center of a hollow gas filled bushing insulator 4*a*, 4*b* that forms a housing around the high voltage conductor. The bushing has two sides, a first side or air side outside the high voltage device to which the bushing is mounted, and a second side or transformer side submerged in an insulating liquid in the high voltage device to which the bushing is fitted, in the present example a transformer, generally designated 20. The transformer contains insulating liquid 22, such as transformer oil, which is enclosed by a tank, designated 24.

The air side of the transformer bushing is similar to a conventional gas insulated gas-to-air bushing, mainly consisting of the high voltage conductor 2 and an air side insulator 4*a* separating the gas inside the bushing from the surrounding air. Further, the transformer side of the bushing is separated from the oil 22 in the transformer by a transformer side insulator 4*b*.

The insulator, which is preferably made of a composite material, such as epoxy, but could also be made of porcelain, thus comprises two portions: an air side insulator 4*a* on the air side of the bushing and a transformer side insulator 4*b* on the transformer side of the bushing.

A flange 6 is provided to electrically connect the housing of the bushing to ground 28 through the tank 24 of the transformer 20.

A so-called throat shield or voltage grading shield in the form of a concentric grounded tube 8 is provided inside the hollow bushing insulator 4*a*, 4*b* around the portion of the bushing going into the tank 24. This shield 8, which is made of a suitable conductive material, such as aluminum, accomplishes grading of the electrical field in the bushing and is used instead of a condenser core. The voltage grading shield 8 is surrounded by the insulating gas, such as SF6 or $N_2$ or mixtures thereof, which is provided in the space 10*a* inside of the air side insulator 4*a* and the space 10*b* inside of the transformer side insulator 4*b*. It is preferred that these two spaces 10*a*, 10*b* are in communication with each other to provide circulation of the insulating gas, thereby improving cooling of the transformer side of the bushing 1.

In DC applications, the inside of the transformer side insulator 4*b*, i.e., the surface of the transformer side insulator facing the insulation gas inside the insulator, may be covered with a dielectric material (not shown) with a relatively low resistivity, such as silicone rubber, composite material or varnish. Since the resistivity of silicone rubber is almost of the same order of magnitude as that of the oil inside the transformer, improved electric field distribution is obtained. This layer minimizes internal radial field stresses in the transformer side insulator 4*b* separating the gas in the bushing 1 from the oil 22 in the transformer 20 and provides a smooth grading of the potential along the transformer side insulator 4*b* between the high voltage and the grounded flange 6 and increases thereby the dielectric strength of the insulator 4*b*.

Optimal performance is obtained by a geometrical design of the transformer side insulator 4*b*. In the preferred embodiment, the transformer side insulator has an essentially frusto-conical shape. This could be supplemented by the thickness of the coating on the inside of the bushing or the thickness of the insulator 4*b* housing. In order to further improve the performance, the thickness of the coating can vary along the transformer side of bushing.

A shielding ring 12 provided at the end of the transformer side of the bushing and a corresponding barrier system 26 in the transformer connection can further enhance the performance.

In both AC and DC applications, in order to achieve a smooth grading of the potential along the transformer side insulator 4*b* between the high voltage and the grounded flange, the geometry of the transformer side insulator 4*b* is optimized. Also, in DC applications the geometry of the barrier system 26 in the transformer is taken into account when optimizing the bushing.

A preferred embodiment of a high voltage bushing and a high voltage device according to the invention has been described. A person skilled in the art realizes that these could be varied within the scope of the appended claims. Thus, although the high voltage device to which the inventive high voltage bushing is attached has been described as a transformer, it will be appreciated that this could be other devices containing insulating liquid, such as reactors or breakers.

The inventive bushing has been described as an air-oil bushing, i.e., wherein the first side of the bushing is surrounded by air outside a transformer, for example. It is realized that this first side can be provided in other environments, such as in oil in an oil-oil bushing or in gas in a gas-oil bushing.

The transformer 20 has been described with a barrier 26. It is realized that this barrier is optional.

The bushing has been shown with a second side insulator, which has essentially frusto-conical shape. It will be realized that the shapes of the insulators can deviate from this shape without departing from the inventive concept. Thus, an inventive bushing with an insulator that is at least partly cylindrical will be a possibility.

The invention claimed is:

1. A high voltage bushing for a high voltage device containing insulating liquid, the high voltage bushing comprising:

a hollow insulator housing comprising a first side insulator arranged to be provided outside of the high voltage device and a second side insulator arranged to be submerged in the insulating liquid of the high voltage device, a high voltage conductor provided in the hollow insulator housing;

a grounded voltage grading shield provided between the high voltage conductor and the first side insulator and the second side insulator; and a flange arranged to electrically connect the housing of the bushing to ground.

2. The high voltage bushing according to claim 1, wherein the voltage grading shield comprises a concentric grounded tube.

3. The high voltage bushing according to claim 1, wherein the voltage grading shield comprises a conductive material.

4. The high voltage bushing according to claim 3, wherein the conductive material comprises aluminum.

5. The high voltage bushing according to claim 1, further comprising:

an insulating gas inside the hollow insulator housing and surrounding the voltage grading shield.

6. The high voltage bushing according to claim 5, wherein a space inside of the first side insulator and a space inside of the second side insulator are in communication with each other.

7. The high voltage bushing according to claim 5, wherein the insulating gas comprises sulfur hexafluoride or molecular nitrogen.

8. The high voltage bushing according to claim 1, further comprising:

a layer of dielectric material having a relatively low resistivity provided on the inner surface of the second side insulator.

9. The high voltage bushing according to claim 8, wherein the layer of dielectric material comprises any of silicon rubber, composite material or varnish.

10. The high voltage bushing according to claim 1, wherein the second side insulator has essentially a frusto-conical shape.

11. The high voltage bushing according to claim 1, wherein the second side insulator comprises an insulating material.

12. The high voltage bushing according to claim 11, wherein the insulating material comprises a composite material or porcelain.

13. The high voltage bushing according to claim 1, wherein the first side insulator is arranged to be surrounded by any of the following: air, oil, and gas.

14. An electrical device, comprising:

a high voltage device; and at least one bushing, each of the at least one bushing comprising:

a hollow insulator housing comprising a first side insulator arranged to be provided outside of the transformer and a second side insulator arranged to be submerged in the insulating liquid of the transformer, a high voltage conductor provided in the hollow insulator housing;

a grounded voltage grading shield provided between the high voltage conductor and the first side insulator and the second side insulator; and a flange arranged to electrically connect the housing of the bushing to ground.

15. The electrical device according to claim 14, wherein the high voltage device comprises one of a transformer, a reactor or a breaker.

* * * * *